US009670848B2

(12) United States Patent
Choi et al.

(10) Patent No.: US 9,670,848 B2
(45) Date of Patent: Jun. 6, 2017

(54) VARIABLE COMPRESSION RATIO ENGINE

(71) Applicant: Hyundai Motor Company, Seoul (KR)

(72) Inventors: Myungsik Choi, Seoul (KR); Young Hong Kwak, Suwon-Si (KR)

(73) Assignee: Hyundai Motor Company, Seoul (KR)

( * ) Notice: Subject to any disclaimer, the term of this patent is extended or adjusted under 35 U.S.C. 154(b) by 191 days.

(21) Appl. No.: 14/525,117

(22) Filed: Oct. 27, 2014

(65) Prior Publication Data

US 2015/0184597 A1 Jul. 2, 2015

(30) Foreign Application Priority Data

Dec. 30, 2013 (KR) ..... 10-2013-0167811

(51) Int. Cl.
*F02D 15/04* (2006.01)

(52) U.S. Cl.
CPC ..... *F02D 15/04* (2013.01)

(58) Field of Classification Search
CPC ..... F02B 75/048; F02B 75/041; F02B 37/00; F02D 15/04; F02D 13/0249; F02D 2041/001
USPC ..... 123/78 AA, 48 AA
See application file for complete search history.

(56) References Cited

U.S. PATENT DOCUMENTS 4,516,537 A * 5/1985 Nakahara ..... F02D 15/04 123/48 AA
6,604,495 B2 * 8/2003 Moteki ..... F02B 75/048 123/48 B
6,647,935 B2 * 11/2003 Aoyama ..... F01L 1/024 123/198 F
6,792,924 B2 * 9/2004 Aoyama ..... F01L 1/34 123/197.4
2002/0050252 A1 * 5/2002 Moteki ..... F02B 75/045 123/48 B

FOREIGN PATENT DOCUMENTS

JP 60075728 A * 4/1985
JP 11-050866 A 2/1999
JP 2009-036128 A 2/2009
JP 2009-036188 A 2/2009
JP 2012229642 A * 11/2012
KR 100130587 B1 4/1998
(Continued)

*Primary Examiner* — Long T Tran
(74) *Attorney, Agent, or Firm* — Morgan, Lewis & Bockius LLP

(57) ABSTRACT

A variable compression ratio engine may include a variable chamber housing communicated with a combustion chamber of the engine, a variable chamber piston slidably disposed within the variable chamber housing, forming a variable chamber communicated with the combustion chamber within the variable chamber housing, forming a hydraulic pressure chamber between the variable chamber piston and the variable chamber housing, and having a leaking line for flowing oil leaked from the hydraulic pressure chamber, a connecting shaft connected to the variable chamber piston, and having an oil drain line for exhausting the oil in the leaking line is formed thereto, an oil supplier supplying oil to the hydraulic pressure chamber, and a compression ratio controller connected to the connecting shaft and controlling a relative position of the variable chamber piston.

17 Claims, 3 Drawing Sheets

(56) References Cited

FOREIGN PATENT DOCUMENTS

| | | | |
|---|---|---|---|
| KR | 1998-047819 | U | 9/1998 |
| KR | 1998-050235 | A | 9/1998 |
| KR | 10-2012-0010881 | A | 2/2012 |
| KR | 10-1382318 | B1 | 4/2014 |

* cited by examiner

VARIABLE COMPRESSION RATIO ENGINE

CROSS-REFERENCE TO RELATED APPLICATION

The present application claims priority to Korean Patent Application No. 10-2013-0167811 filed Dec. 30, 2013, the entire contents of which is incorporated herein for all purposes by this reference.

BACKGROUND OF THE INVENTION

1. Field of the Invention

The present invention relates to a variable compression ratio engine. More particularly, the present invention relates to a variable compression ratio engine, which may absorb combustion impact and may improve durability.

2. Description of Related Art

In general, the compression ratio of an internal combustion engine is represented by the largest volume of a combustion chamber prior to compression and the smallest volume of the combustion chamber after compression in a compression stroke of the internal combustion engine.

The output of the internal combustion engine increases as the compression ratio of the internal combustion engine is increased. However, if the compression ratio of the internal combustion engine is too high, so-called knocking occurs, and this even decreases the output of the internal combustion engine and also results in overheating of the internal combustion engine, a failure in a valve or piston of the internal combustion engine, and so on.

Accordingly, the compression ratio of the internal combustion engine is set to a specific value within an appropriate range prior to the occurrence of knocking. As such, because the air-fuel ratio and output of the internal combustion engine can be improved by properly varying the compression ratio according to the load of the internal combustion engine, various approaches are being proposed to vary the compression ratio of the internal combustion engine.

These approaches for varying the compression ratio of the internal combustion engine mostly employ methods that vary the volume of the compression chamber during a compression stroke.

For example, there have been proposed methods that vary the height of the top dead center of a piston during a compression stroke, or increase or decrease the volume of a sub-compression chamber provided in a cylinder head.

Varying the height of the top dead center of a piston tends to make the structure of the internal combustion engine complicated. Therefore, it will be desirable to vary the compression ratio by providing a sub-compression chamber in a cylinder head to make the structure simple and achieve great improvement in air-fuel ratio.

However, since combustion impact in a combustion stroke is directly transmitted to elements of a variable compression ratio device so that durability of the elements may be deteriorated.

The above information disclosed in this Background of the Invention section is only for enhancement of understanding of the background of the invention and should not be taken as an acknowledgement or any form of suggestion that this information forms the prior art already known to a person skilled in the art.

BRIEF SUMMARY

Various aspects of the present invention are directed to providing a variable compression ratio engine having advantages of improving durability, reducing power for operating a device, and enhancing responsibility by providing a hydraulic pressure chamber for absorbing combustion impact.

According to an aspect of the present invention, a variable compression ratio engine may include a variable chamber housing communicated with a combustion chamber of the engine, a variable chamber piston slidably disposed within the variable chamber housing, forming a variable chamber communicated with the combustion chamber within the variable chamber housing, forming a hydraulic pressure chamber between the variable chamber piston and the variable chamber housing, and having a leaking line for flowing oil leaked from the hydraulic pressure chamber, a connecting shaft connected to the variable chamber piston, and having an oil drain line for exhausting the oil in the leaking line, an oil supplier supplying oil to the hydraulic pressure chamber, and a compression ratio controller connected to the connecting shaft and controlling a relative position of the variable chamber piston.

A piston ring may be interposed between the variable chamber piston and the variable chamber housing.

A leaking groove may be formed on the variable chamber piston for the oil leaked from the hydraulic pressure chamber to be temporarily stored.

An oil hole may be formed on the variable chamber housing, and the oil supplier may include a hydraulic pump and an oil control valve selectively supplying oil which is received from the hydraulic pump to the hydraulic pressure chamber through the oil hole.

The oil supplier may further include an accumulator communicated with the oil control valve.

The oil supplier may further include a check valve disposed between the hydraulic pump and the oil control valve.

The compression ratio controller may include a control shaft, an eccentric cam connected to the control shaft, a connecting link connecting the eccentric cam to the connecting shaft, and a driving unit selectively rotating the control shaft.

The driving unit may include a worm wheel connected to the control shaft, and a drive motor driving a worm engaged with the worm wheel.

The compression ratio controller may include a crank control shaft connected to the connecting shaft, and a driving unit selectively rotating the crank control shaft.

The driving unit may include a worm wheel connected to the crank control shaft, and a drive motor driving a worm engaged with the worm wheel.

An exemplary variable compression ratio engine according to the present invention may improve durability, reduce power for operating a device, and enhance responsibility by providing a hydraulic pressure chamber for absorbing combustion impact.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
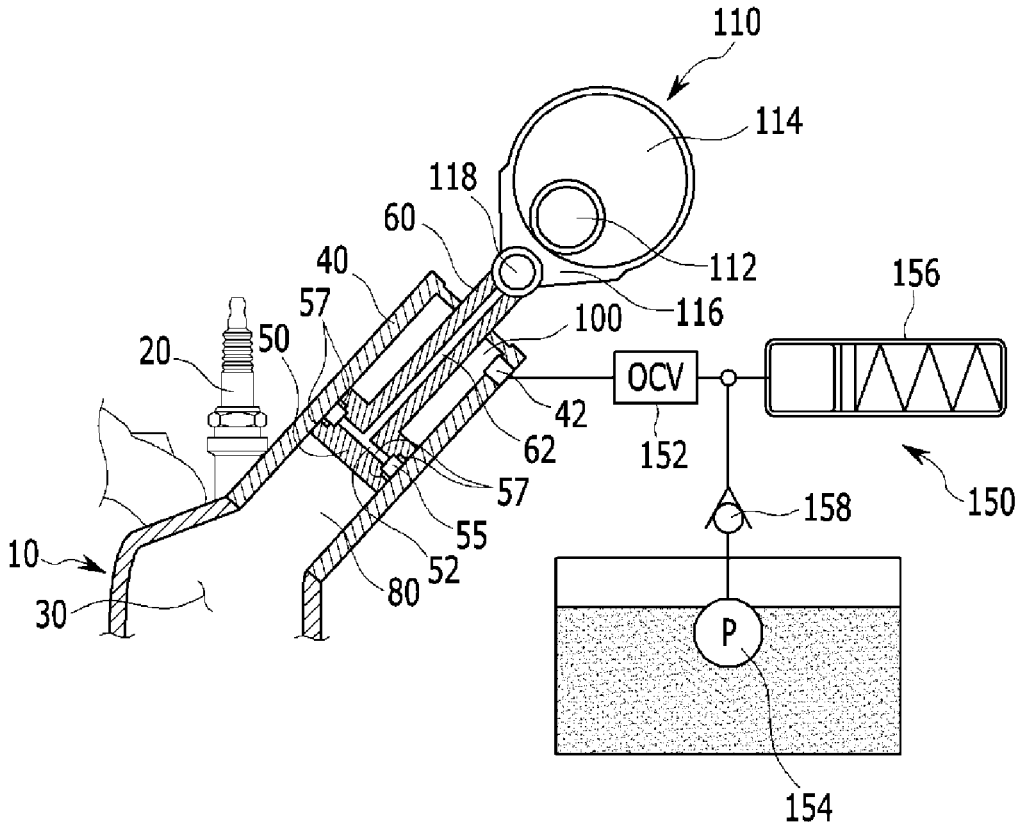
FIG. 1 is a cross-sectional view of an exemplary variable compression ratio engine according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification and the claims, unless explicitly described to the contrary, the word "comprise" and variations such as "comprises" or "comprising", will be understood to imply the inclusion of stated elements but not the exclusion of any other elements.

Figure 2:
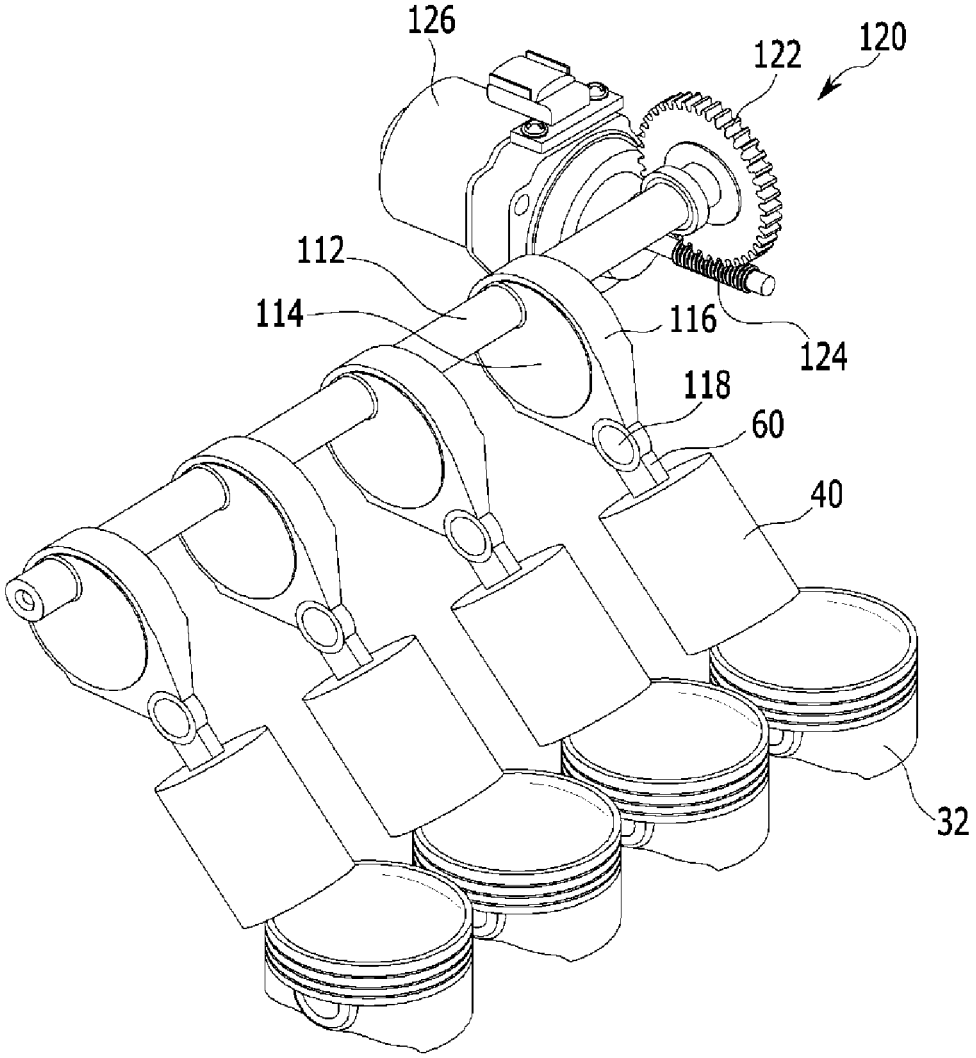
FIG. 2 is a partial perspective view of the exemplary variable compression ratio engine according to the present invention.

FIG. 1 is a cross-sectional view of an exemplary variable compression ratio engine according to the present invention, and FIG. 2 is a partial perspective view the exemplary variable compression ratio engine according to the present invention.

Referring to FIG. 1 and FIG. 2, a variable compression ratio engine 10 includes a variable chamber housing 40 communicated with a combustion chamber 30, a variable chamber piston 50 slidably disposed within the variable chamber housing 40 and forming a variable chamber 80 communicated with the combustion chamber 30, a connecting shaft 60 connected with the variable chamber piston 50, an oil supplier 150 and a compression ratio controller 110.

The variable chamber piston 50 forms a hydraulic pressure chamber 100 together with the variable chamber housing 40, and of which a leaking line 52 for flowing oil leaked from the hydraulic pressure chamber 100 is formed thereto.

An oil drain line 62 is formed on the connecting shaft 60 for exhausting the oil in the leaking line 52, and the oil supplier 150 supplies oil to the hydraulic pressure chamber 100.

A piston ring 57 is interposed between the variable chamber piston 50 and the variable housing 40 for suppressing leakage of the oil in the hydraulic pressure chamber 100.

A leaking groove 55 is formed on the variable chamber piston 50 for the oil leaked from the hydraulic pressure chamber 100 to be temporarily stored. Thus, when the oil is leaked between the piston ring 57 and the variable chamber housing 40, the leaking groove 55 may temporarily keep the oil.

The variable compression ratio engine 10 according may be an engine provided with a spark plug 20 and the variable chamber housing 40 to a cylinder head, and thus with simple design change may realize the variable compression ratio engine 10.

An oil hole 42 is formed on the variable chamber housing 40, and the oil supplier 150 includes a hydraulic pump 154 and an oil control valve 152 selectively supplying oil supplied from the hydraulic pump 154 to the hydraulic pressure chamber 100 through the oil hole 42.

The oil supplier 150 may further include an accumulator 156 communicated with the oil control valve 152, and a check valve 158 disposed between the hydraulic pump 154 and the oil control valve 152. The check valve 158 may prevent the oil from flowing backward to the hydraulic pump 154.

The compression ratio controller 110 includes a control shaft 112, an eccentric cam 114 connected with the control shaft 112, a connecting link 116 connecting the eccentric cam 114 with the connecting shaft 60, and a driving unit 120 selectively rotating the control shaft 112. The connecting shaft 60 and the connecting link 116 are connected by a connecting pin 118.

The driving unit 120 includes a worm wheel 122 connected with the control shaft 112 and a drive motor 126 driving a worm 124 engaged with the worm wheel 122.

Referring to FIG. 1 and FIG. 2, operations of the exemplary variable compression ratio engine 10 according to the present invention will be discussed.

According to operation conditions of an engine, an engine control portion (ECU) determines compression ratio.

For example, in a partial load zone, the variable compression ratio engine 10 is operated with high compression ratio for improving fuel consumption, and the variable compression ratio engine 10 is operated with low compression ratio for enhancing torque in a full load zone.

That is, in the partial load zone, the engine control portion controls operation of the drive motor 126 for the control shaft 112 to be rotated in order for the variable chamber piston 50 to move toward the combustion chamber 30.

Then, volume of the variable chamber 80 is reduced so as to increase compression ratio of the engine 10, and thus enhancement of fuel consumption may be realized.

In the full load, the engine control portion controls operation of the drive motor 126 for the control shaft 112 to be rotated in order for the variable chamber piston 50 to move away from the combustion chamber 30.

Then, volume of the variable chamber 80 is increased so as to reduce the compression ratio of the engine 10, and torque of the engine may be increased.

In this case, combustion pressure of the combustion chamber 30 is transmitted to the variable chamber piston 50 and then it is transmitted to the oil in the hydraulic pressure chamber 100. The combustion pressure transmitted to the oil is dispersed to the variable chamber housing 40 and the cylinder head connected to the variable chamber housing 40.

Thus, explosion impact due to combustion of fuel is not transmitted to a specific element but transmitted to entire elements of the engine and entire durability may be improved.

In this process, partial oil may leak out due to the impact transmitted to the hydraulic pressure chamber 100.

The piston ring 57 interposed between the variable chamber piston 50 and the variable chamber housing 40 may suppress leakage of the oil in the hydraulic pressure chamber 100. Even though there may be leakage of the oil between the piston ring 57 and the variable chamber housing 40, the leaking groove 55 may temporarily store the leaked oil.

The leaked oil may be exhausted through the leaking line 52 and the oil drain line 62. Pressure within the hydraulic pressure chamber 100 is increased due to explosion impact during combustion, and the pressure may discharge the oil.

When the engine control portion controls the operation of the compression ratio controller 110 for the variable chamber piston 50 to be moved, the engine control portion also control operation of the oil control valve 152.

That is, when the compression ratio of the engine 10 is reduced, the oil control valve 152 releases the oil within the hydraulic pressure chamber 100 by the control of the control portion. On the contrary, when the compression ratio of the engine 10 is increased, the oil control valve 152 supplies the oil to the hydraulic pressure chamber 100 by the control of the control portion.

When the oil control valve 152 release the oil in the hydraulic pressure chamber 100, the oil may be stored in the accumulator 156, and when the oil control valve 152 supplies the oil to the hydraulic pressure chamber 100, the oil stored in the accumulator 156 may be supplied thereto. In this way, supplying and releasing of the oil may be achieved smoothly.

Figure 3:
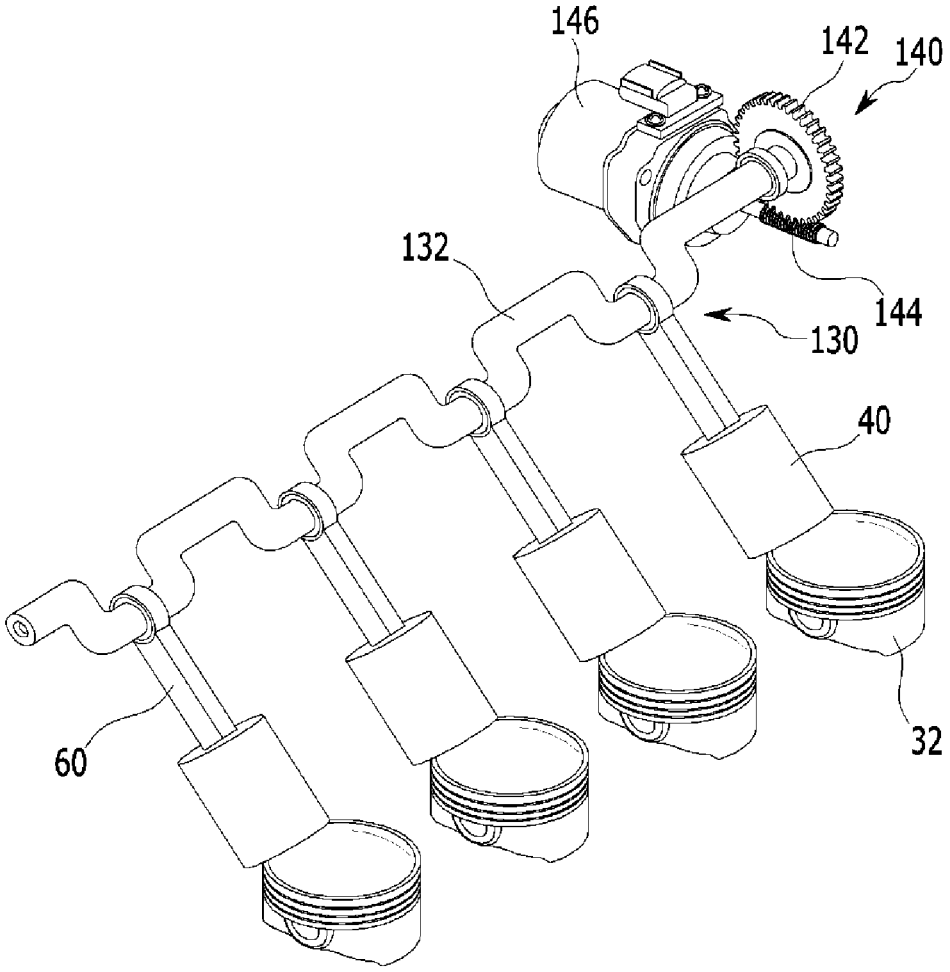
FIG. 3 is a partial perspective view of an exemplary variable compression ratio engine according to the present invention.

FIG. 3 is a partial perspective view an exemplary variable compression ratio engine according to the present invention.

A compression ratio controller 130 of the exemplary variable compression ratio engine according to the present invention may include a crank control shaft 132 connected with the connecting shaft 60 and a driving unit 140 selectively rotating the crank control shaft 132

The driving unit 140 includes a worm wheel 142 connected with the crank control shaft 132 and a drive motor 146 driving a worm 144 engaged with the worm wheel 142.

When the driving unit 140 operates to rotate the crank control shaft 132, relative position of the variable chamber piston 50 is changed to vary compression ratio of the engine.

The exemplary embodiment of the present invention shown in FIG. 3, is similar to the exemplary embodiment of the present invention shown in FIG. 1 and FIG. 2 except for the compression ratio controller so that repeated description will be omitted.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio engine comprising:

a variable chamber housing communicated with a combustion chamber of the engine;

a variable chamber piston slidably disposed within the variable chamber housing, forming a variable chamber communicated with the combustion chamber within the variable chamber housing, forming a hydraulic pressure chamber between the variable chamber piston and the variable chamber housing, and having a leaking line for flowing oil leaked from the hydraulic pressure chamber;

a connecting shaft connected to the variable chamber piston, and having an oil drain line for exhausting the oil in the leaking line;

an oil supplier supplying oil to the hydraulic pressure chamber; and a compression ratio controller connected to the connecting shaft and controlling a relative position of the variable chamber piston, wherein the compression ratio controller comprises:

a control shaft;

an eccentric cam connected to the control shaft;

a connecting link connecting the eccentric cam to the connecting shaft; and a driving unit selectively rotating the control shaft, and wherein the driving unit comprises:

a worm wheel connected to the control shaft; and a drive motor driving a worm engaged with the worm wheel.

2. The engine of claim 1, wherein a piston ring is interposed between the variable chamber piston and the variable chamber housing.

3. The engine of claim 1, wherein a leaking groove is formed on the variable chamber piston for the oil leaked from the hydraulic pressure chamber to be temporarily stored.

4. The engine of claim 1, wherein an oil hole is formed on the variable chamber housing, and the oil supplier comprises:

a hydraulic pump; and an oil control valve selectively supplying oil received from the hydraulic pump to the hydraulic pressure chamber through the oil hole.

5. The engine of claim 4, wherein the oil supplier further comprises an accumulator communicated with the oil control valve.

6. The engine of claim 5, wherein the oil supplier further comprises a check valve disposed between the hydraulic pump and the oil control valve.

7. The engine of claim 1, wherein the compression ratio controller comprises:

a crank control shaft connected to the connecting shaft; and a driving unit selectively rotating the crank control shaft.

8. The engine of claim 7, wherein the driving unit comprises:

a worm wheel connected to the crank control shaft; and a drive motor driving a worm engaged with the worm wheel.

9. A variable compression ratio engine comprising:

a variable chamber housing communicated with a combustion chamber of the engine;

a variable chamber piston slidably disposed within the variable chamber housing, forming a variable chamber communicated with the combustion chamber within the variable chamber housing, forming a hydraulic pressure chamber between the variable chamber piston and the variable chamber housing, and having a leaking line for flowing oil leaked from the hydraulic pressure chamber;

a connecting shaft connected to the variable chamber piston, and having an oil drain line for exhausting the oil in the leaking line;

an oil supplier supplying oil to the hydraulic pressure chamber; and a compression ratio controller connected to the connecting shaft and controlling a relative position of the variable chamber piston, wherein the compression ratio controller comprises:

a crank control shaft connected to the connecting shaft; and a driving unit selectively rotating the crank control shaft.

10. The engine of claim 9, wherein a piston ring is interposed between the variable chamber piston and the variable chamber housing.

11. The engine of claim 9, wherein a leaking groove is formed on the variable chamber piston for the oil leaked from the hydraulic pressure chamber to be temporarily stored.

12. The engine of claim 9, wherein an oil hole is formed on the variable chamber housing, and the oil supplier comprises:

a hydraulic pump; and an oil control valve selectively supplying oil received from the hydraulic pump to the hydraulic pressure chamber through the oil hole.

13. The engine of claim 12, wherein the oil supplier further comprises an accumulator communicated with the oil control valve.

14. The engine of claim 13, wherein the oil supplier further comprises a check valve disposed between the hydraulic pump and the oil control valve.

15. The engine of claim 9, wherein the compression ratio controller comprises:

a control shaft;

an eccentric cam connected to the control shaft;

a connecting link connecting the eccentric cam to the connecting shaft; and a driving unit selectively rotating the control shaft.

16. The engine of claim 15, wherein the driving unit comprises:

a worm wheel connected to the control shaft; and a drive motor driving a worm engaged with the worm wheel.

17. The engine of claim 9, wherein the driving unit comprises:

a worm wheel connected to the crank control shaft; and a drive motor driving a worm engaged with the worm wheel.

* * * * *